US008855345B2

(12) United States Patent
Shennib et al.

(10) Patent No.: US 8,855,345 B2
(45) Date of Patent: Oct. 7, 2014

(54) BATTERY MODULE FOR PERPENDICULAR DOCKING INTO A CANAL HEARING DEVICE

(75) Inventors: Adnan Shennib, Oakland, CA (US); Victor Valenzuela, Hayward, CA (US); Patrick Contioso, Sunnyvale, CA (US)

(73) Assignee: iHear Medical, Inc., San Leandro, CA (US)

( * ) Notice: Subject to any disclaimer, the term of this patent is extended or adjusted under 35 U.S.C. 154(b) by 210 days.

(21) Appl. No.: 13/424,242

(22) Filed: Mar. 19, 2012

(65) Prior Publication Data

US 2013/0243229 A1 Sep. 19, 2013

(51) Int. Cl.
*H04R 25/00* (2006.01)

(52) U.S. Cl.
USPC ..... 381/323; 381/322; 381/324

(58) Field of Classification Search
USPC ..... 381/314, 322, 323, 324, 325, 326, 328, 381/380; 600/25; 607/56, 57
See application file for complete search history.

(56) References Cited

U.S. PATENT DOCUMENTS

| | | | |
|---|---|---|---|
| 4,759,070 | A | 7/1988 | Voroba |
| 5,197,332 | A | 3/1993 | Shennib |
| 5,327,500 | A | 7/1994 | Campbell |
| 5,553,152 | A | 9/1996 | Newton |
| 5,645,074 | A | 7/1997 | Shennib et al. |
| 5,659,621 | A | 8/1997 | Newton |
| 5,701,348 | A | 12/1997 | Shennib et al. |
| 5,785,661 | A | 7/1998 | Shennib et al. |
| 6,137,889 | A | 10/2000 | Shennib et al. |
| 6,212,283 | B1 | 4/2001 | Fletcher et al. |
| 6,319,207 | B1 | 11/2001 | Naidoo |
| 6,359,993 | B2 | 3/2002 | Brimhall |
| 6,367,578 | B1 | 4/2002 | Shoemaker |
| 6,379,314 | B1 | 4/2002 | Horn |
| 6,382,346 | B2 | 5/2002 | Brimhall et al. |
| 6,428,485 | B1 | 8/2002 | Rho |
| 6,447,461 | B1 | 9/2002 | Eldon |
| 6,473,513 | B1 | 10/2002 | Shennib et al. |
| 6,522,988 | B1 | 2/2003 | Hou |

(Continued)

FOREIGN PATENT DOCUMENTS

| | | |
|---|---|---|
| WO | WO-99/07182 A2 | 2/1999 |
| WO | 2010/091480 | 8/2010 |

OTHER PUBLICATIONS

"Lyric User Guide", http://www.phonak.com/content/dam/phonak/b2b/C_M_tools/Hearing_Instruments/Lyric/documents/02-gb/Userguide_Lyric_V8_GB_FINAL_WEB.pdf, Jul. 2010.
"User Manual-2011", AMP Personal Audio Amplifiers.

(Continued)

*Primary Examiner* — Huyen D Le
(74) *Attorney, Agent, or Firm* — Dorsey & Whitney LLP

(57) ABSTRACT

A modular canal hearing aid assembly having a main module and a disposable battery module that docks perpendicularly into the main module which surrounds the battery module circumferentially and laterally for secure connection that eliminates inadvertent separation of the modules during removal of the hearing aid assembly from the ear canal. The disposable battery module incorporates battery cell, sound port, and handle, in a unitary structure that is easy to handle and replace as an integrated unit when any of the degradables within are consumed. The disposable battery module also comprises a membrane filter for filtering out earwax and liquids. The perpendicular docking mechanism provides highly space efficient design for comfortable and inconspicuous fit deep in the ear canal.

30 Claims, 9 Drawing Sheets

(56) References Cited

U.S. PATENT DOCUMENTS

| | | | | |
|---|---|---|---|---|
| 6,546,108 | B1 | 4/2003 | Shennib et al. | |
| 6,674,862 | B1 | 1/2004 | Magilen | |
| 6,724,902 | B1 | 4/2004 | Shennib et al. | |
| 6,840,908 | B2 | 1/2005 | Edwards et al. | |
| 6,937,735 | B2 | 8/2005 | DeRoo et al. | |
| 6,940,988 | B1 | 9/2005 | Shennib et al. | |
| 6,978,155 | B2 | 12/2005 | Berg | |
| 7,016,511 | B1 | 3/2006 | Shennib | |
| 7,037,274 | B2 | 5/2006 | Thoraton et al. | |
| 7,113,611 | B2 | 9/2006 | Leedom et al. | |
| 7,215,789 | B2 | 5/2007 | Shennib et al. | |
| 7,260,232 | B2 | 8/2007 | Shennib | |
| 7,298,857 | B2 | 11/2007 | Shennib et al. | |
| 7,310,426 | B2 | 12/2007 | Shennib et al. | |
| 7,321,663 | B2 | 1/2008 | Olsen | |
| 7,403,629 | B1 | 7/2008 | Aceti et al. | |
| 7,424,123 | B2 | 9/2008 | Shennib et al. | |
| 7,424,124 | B2 | 9/2008 | Shennib et al. | |
| 7,580,537 | B2 | 8/2009 | Urso et al. | |
| 7,664,282 | B2 | 2/2010 | Urso et al. | |
| 7,854,704 | B2 | 12/2010 | Givens et al. | |
| 7,945,065 | B2 | 5/2011 | Menzl et al. | |
| 8,073,170 | B2 | 12/2011 | Kondo et al. | |
| 8,077,890 | B2 | 12/2011 | Schumaier | |
| 8,155,361 | B2 | 4/2012 | Schindler | |
| 8,184,842 | B2 | 5/2012 | Howard et al. | |
| 8,243,972 | B2 | 8/2012 | Latzel | |
| 8,284,968 | B2 | 10/2012 | Schumaier | |
| 8,287,462 | B2 | 10/2012 | Givens et al. | |
| 8,379,871 | B2 | 2/2013 | Michael et al. | |
| 8,396,237 | B2 | 3/2013 | Schumaier | |
| 8,447,042 | B2 | 5/2013 | Gurin | |
| 8,467,556 | B2 | 6/2013 | Shennib et al. | |
| 2001/0008560 | A1 | 7/2001 | Stonikas et al. | |
| 2002/0027996 | A1 | 3/2002 | Leedom et al. | |
| 2002/0085728 | A1 | 7/2002 | Shennib et al. | |
| 2005/0245991 | A1 | 11/2005 | Faltys et al. | |
| 2005/0259840 | A1* | 11/2005 | Gable et al. | 381/323 |
| 2005/0283263 | A1 | 12/2005 | Eaton et al. | |
| 2006/0291683 | A1 | 12/2006 | Urso et al. | |
| 2010/0040250 | A1 | 2/2010 | Gebert | |
| 2010/0119094 | A1* | 5/2010 | Sjursen et al. | 381/323 |
| 2010/0145411 | A1 | 6/2010 | Spitzer | |
| 2010/0239112 | A1 | 9/2010 | Howard et al. | |
| 2011/0058697 | A1 | 3/2011 | Shennib et al. | |
| 2011/0188689 | A1 | 8/2011 | Beck et al. | |
| 2012/0051569 | A1 | 3/2012 | Blamey et al. | |
| 2012/0130271 | A1 | 5/2012 | Margolis et al. | |
| 2012/0183164 | A1 | 7/2012 | Foo et al. | |
| 2012/0183165 | A1 | 7/2012 | Foo et al. | |
| 2012/0189140 | A1 | 7/2012 | Hughes | |
| 2012/0213393 | A1 | 8/2012 | Foo et al. | |
| 2012/0215532 | A1 | 8/2012 | Foo et al. | |
| 2013/0010406 | A1 | 1/2013 | Stanley | |
| 2013/0294631 | A1 | 11/2013 | Shennib et al. | |
| 2014/0003639 | A1 | 1/2014 | Shennib et al. | |

OTHER PUBLICATIONS

International Search Report and Written Opinion dated Nov. 3, 2010 for PCT Appl. No. US2010/048299.

"Methods for Calculation of the Speech Intelligibility Index", American National Standards Institute, Jun. 6, 1997.

"Specification for Audiometers", American National Standards Institute, Nov. 2, 2010.

Abrams, "A Patient-adjusted Fine-tuning Approach for Optimizing the Hearing Aid Response", The Hearing Review, Mar. 24, 2011, 1-8.

Asha, "Type, Degree, and Configuration of Hearing Loss", American Speech-Language-Hearing Association; Audiology Information Series, May 2011, 1-2.

Convery, et al., "A Self-Fitting Hearing Aid: Need and Concept", http://tia.sagepubl.com, Dec. 4, 2011, 1-10.

Franks, "Hearing Measurements", National Institute for Occupational Safety and Health, Jun. 2006, 183-232.

Kiessling, "Hearing aid fitting procedures—state-of-the-art and current issues", Scandinavian Audiology. vol. 30, Suppl 52, 2001, 57-59.

Nhanes, "Audiometry Procedures Manual", National Health and Nutrition Examination Survey, Jan. 2003, 1-105.

Traynor, "Prescriptive Procedures", www.rehab.research.va.gov/mono/ear/traynor.htm, Jan. 1999, 1-16.

World Health Organization, "Deafness and Hearing Loss", www.who.int/mediacentre/factsheets/fs300/en/index.html. Feb. 2013, 1-5.

* cited by examiner

BATTERY MODULE FOR PERPENDICULAR DOCKING INTO A CANAL HEARING DEVICE

TECHNICAL FIELD

Examples described herein relate to hearing devices, and include particularly hearing devices that are positioned in the ear canal for inconspicuous wear. This application is related to pending patent application Ser. No. 12/878,926, titled CANAL HEARING DEVICE WITH DISPOSABLE BATTERY MODULE incorporated herein in its entirety by this reference.

BACKGROUND

The ear canal 10, as illustrated in FIG. 1, is generally narrow and tortuous and is approximately 26 millimeters (mm) long from the canal aperture 11 to the tympanic membrane 15 (eardrum). The lateral part 12 is referred to as the cartilaginous canal due to the underlying cartilaginous tissue. Hair and earwax (cerumen) are primarily present in this cartilaginous region 12. The medial part, proximal to the tympanic membrane 15, is rigid and referred to as the bony region 13 due to the underlying bone tissue. A characteristic bend roughly occurring at the bony-cartilaginous junction 8 separates the cartilaginous region 12 and the bony region 13. The dimensions and contours of the ear canal vary significantly among individuals. There is a characteristic "S" shape with a first and second bends generally occurring at the aperture area 11 and junction area 8, respectively (FIG. 2).

Canal dimensions vary significantly along the ear canal and among individuals. Placement of a hearing device substantially inside the ear canal is problematic due to extreme level of miniaturization required and the limited reliability of small parts. Furthermore, access and manipulation of a miniature canal device becomes prohibitive when placed too deeply in the bony region. However, it is desirable to deliver sound deeply, at least into the junction area 8, to achieve electroacoustic advantages including reduction of the acoustic occlusion effect, improved energy efficiency, reduced distortion, reduced receiver vibrations, and improved high frequency response. FIG. 2 shows a top-down view of the ear canal, indicting the narrowness of the contoured ear canal and the challenge of placing and navigating a hearing aid assembly within.

Physiological debris is primarily present in the cartilaginous region 12 of the ear canal, and includes cerumen (earwax), sweat, and oils produced by the various glands underneath the skin in the cartilaginous region. Debris in the ear canal is a major cause of damage to canal hearing devices resulting in clogging of sound ports and frequent repairs. If sounds ports are not protected, debris often flows into the interior, and particularly the microphone causing damage. On the other hand if a sound port is protected by a permanent filter, it will eventually get contaminated by earwax disabling the hearing device.

SUMMARY

The present invention provides a universal canal hearing device assembly that is inconspicuous and delivers amplified sound in proximity to the eardrum. The canal hearing device comprises a main module and a disposable battery module incorporating a sound port within. The battery module is restricted to perpendicular insertion and removal, into and from a main module forming a hearing device assembly when joined thereto. The unique perpendicular joining of the module and circumferential encapsulation by the main module eliminates inadvertent separation of battery module during axial movements of assembled hearing device inside the ear canal. The main module fits safely and primarily in the cartilaginous region of the ear canal and it incorporates durable components intended for long-term operation. On the other hand, the disposable battery module incorporates consumable components that deplete or deteriorate within relatively a short period of time, such as the battery and incoming sound port. The sound port is protected by an acoustically transparent membrane filter to prevent water ingress and debris from going through and reaching the microphone within the main module.

The disposable battery module is removable and connects to the main module electrically, mechanically and acoustically for delivering power and incoming sound thereto. The unique modular design of the invention allows for a reliable, predictable, and cost effective maintenance of the canal hearing device by protecting expensive components in the main module designed for long term operation, while periodically disposing degradable elements. The disposable battery module is easier to handle and replace than a battery cell alone as typically used in conventional canal hearing aid designs.

In the preferred embodiments, the battery module assembly is shaped substantially in the shape of a button-cell battery integrated within. The integrated disposable battery module offers a space efficient design by eliminating a battery compartment as practiced in conventional custom hearing aids. The battery module also incorporates a handle with a shaft and a knob for handling and manipulation of the battery module during its insertion or removal from the main module. The disposable battery module incorporates waterproofing elements to allow the assembled hearing device to be safely worn during swimming and showering. Should the debris barrier becomes soiled or damaged, such as after exposure to chlorinated water, hair spray, etc., the disposable battery module assembly is simply removed and replaced.

A unique aspect of the present invention is the perpendicular docking of the battery module into the main module, with respect to the axial axis of the hearing device assembly and the ear canal. To accomplish this, the main module is designed with a lateral cavity for receiving the battery module perpendicularly. The main module cavity substantially encapsulates, circumferentially and latterly, the battery module for preventing axial separation while providing highly space-efficient electromechanical interlocking The main module also connects to a seal assembly positioned concentrically over it and designed with safety considerations to prevent inadvertent insertion into the eardrum. The seal tip and main module terminate the device approximately at the boney-cartilaginous junction which is sufficiently deep for mitigating feedback and reducing the acoustic occlusion effect. The seal assembly is preferably removable for disposal or washing thereof, and made of soft compliant material such as Silicone® to fit comfortably and in an acoustically sealing manner inside the ear canal.

The hearing device modules are mass-produced and offered in a generic one-size-fits-all with assorted seal tips for fitting in individual ear canals. This provides an "instant" fit method that eliminates costly custom manufacturing and cumbersome ear canal impression taking.

A further unique aspect of the present invention is the ability to remove the battery module and connect a programming assembly with a programming plug into the main module. The programming assembly connects to a personal computer, including a smart phone, allowing for remote web-enabled programming and fitting.

BRIEF DESCRIPTION OF THE DRAWINGS

The above and still further objectives, features, aspects and attendant advantages of the present invention will become apparent from the following detailed description of certain preferred and alternate embodiments and method of manufacture and use thereof constituting the best mode presently contemplated of practicing the invention, when taken in conjunction with the accompanying drawings, in which.

DETAILED DESCRIPTION OF PREFERRED EMBODIMENTS

Certain details are set forth below to provide a sufficient understanding of embodiments of the invention. However, it will be appreciated by one skilled in the art that some embodiments may not include all details described. In some instances, well-known structures, hearing aid components, circuits, control signals, and software operations have not been shown in detail in order to avoid unnecessarily obscuring the described embodiments of the invention.

Conventional hearing devices and battery modules for such hearing devices may include numerous limitations. For example, prior art battery modules are typically configured to engage with the hearing device along the axial direction. Such axial coupling between the device and battery module is disadvantageous for a number of reasons, including the need for elaborate electromechanical mechanisms to effect such coupling, discomfort to the patient, size increase, risk of decoupling of the battery from the device while in use, risk of inserting the hearing device deeper than intended within the ear canal, and others. Accordingly, there is a need for improved battery modules for hearing aid devices.

Hearing aid devices and battery modules for use with modular canal hearing aid devices and systems are described herein. The hearing aid devices and assemblies described herein are worn substantially inside the ear canal 10 and deliver amplified sound in proximity to the eardrum 15.

Figure 1:
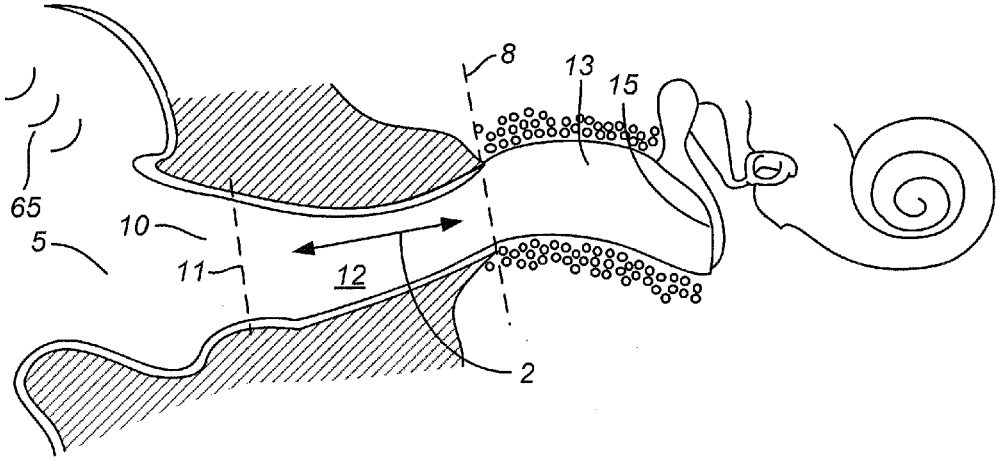
FIG. 1 is a cross-sectional illustration of the external ear canal.
Figure 2:
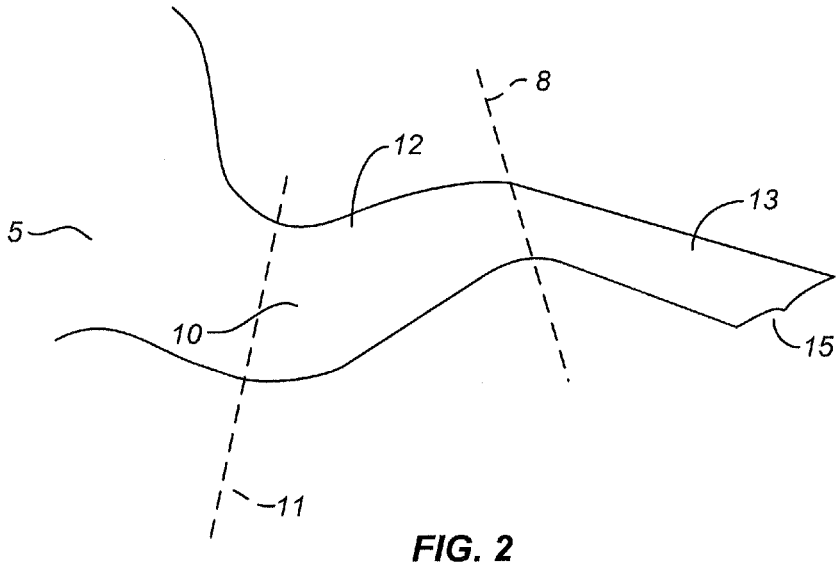
FIG. 2 is a cross-sectional top view of the external ear canal revealing its contours.
Figure 3:
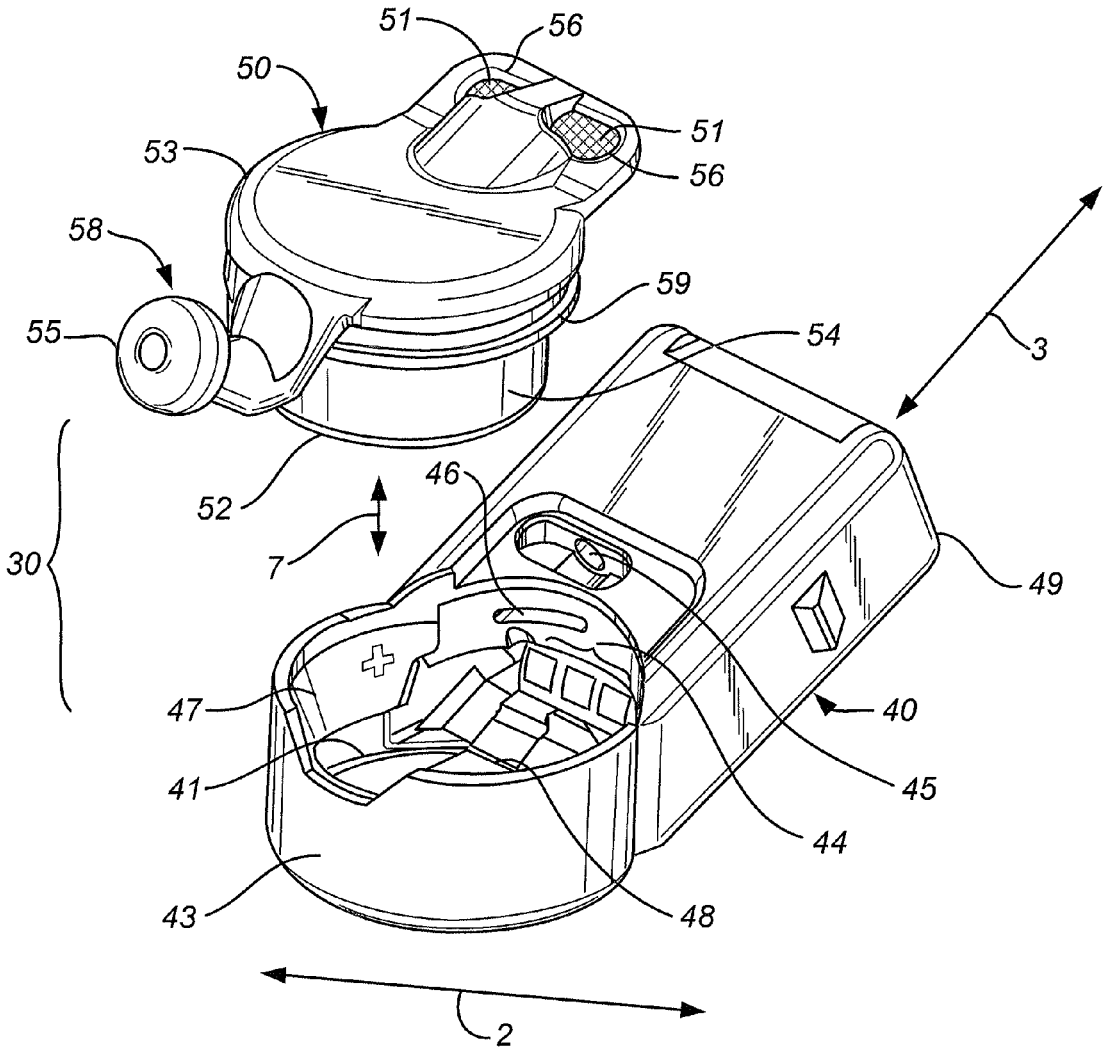
FIG. 3 is an illustration of an exemplary hearing aid device including a battery module configured for perpendicular insertion into the main module according to an embodiment of the present invention.
Figure 5:
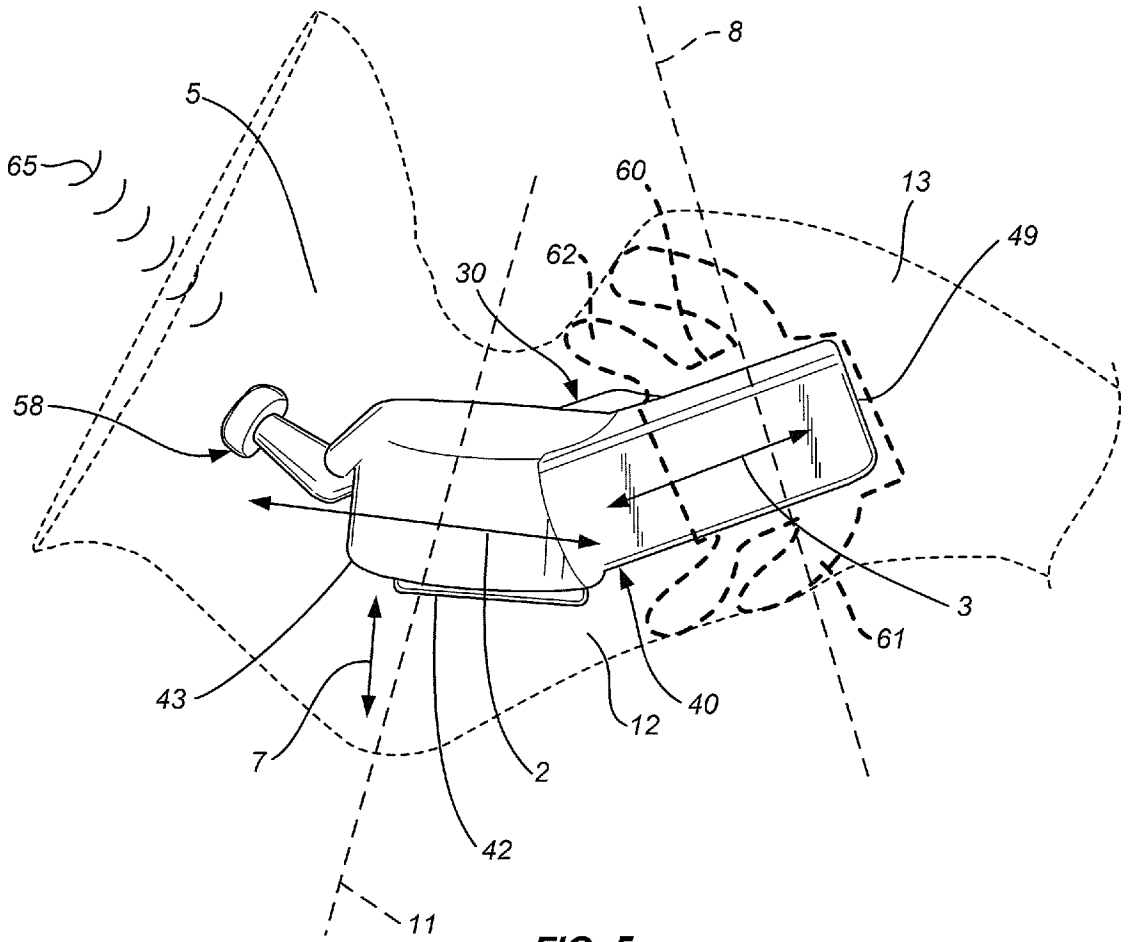
FIG. 5 is a solid model view of the hearing aid device according to an embodiment of the present invention disposed inside an ear canal and illustrating general positioning and orientation of the hearing device assembly inside the ear canal, the angle of the battery module with respect to the main module, and the angle of handle with respect to the battery module, as examples.

FIG. 3 shows an illustration of an example canal hearing aid device including a battery module configured for perpendicular insertion into a main module according to embodiments of the present invention. The hearing aid device 30 is configured to fit substantially inside the ear canal 10 (as shown in FIG. 5) past the canal aperture 11. The main module 40 generally incorporates the expensive components of a typical hearing device, which includes generally the components that are durable and designed for prolonged operation, such as the receiver (e.g., a speaker—not shown), a microphone (not shown) and various hearing aid electronics, including an amplifier circuit (not shown). On the other hand, the battery module 50 incorporates relatively inexpensive and non-durable components that degrades or becomes depleted in a relatively short time, such as the battery cell 52. The components of the battery module (further described below) are integrated together forming a unitary structure which is ready and assembled for the user to use. In this manner, by incorporating primarily inexpensive, non-durable components in the battery module, the battery module is configured to be a disposable unit such that the user, typically an elderly person who may have limited dexterity, would not be required to manipulate a small sized battery cell to insert it in a hearing aid device. The battery module may be implemented as a reusable unit when provided with a rechargeable or replaceable battery cell.

Referring now to FIG. 3, the hearing aid device 30 includes a main module 40 and a battery module 50. The main module 40 may be generally rectangular in cross section and having a medial end 49 and a lateral end 43. Other form factors may of course be used. The main module 40 includes a receiving cavity 41 at the lateral end 43 of the main module. The receiving cavity 41 is generally shaped to conform to the shape of the particular battery cell selected, for example a button cell as shown. The main module 40 includes a plurality of electrical contacts. In some examples, the main module includes electrical contacts 47 and 48 for electrical coupling between the battery and electrical components within the main module (e.g., amplifier circuitry). In some examples, the main module includes data contacts 44 for coupling the main module to a programming device. The main module 40 may include a plurality of apertures proximate a sound port 56 of the battery module 50 (described further below) when the main module and battery module are in engagement. An aperture 46 is provided in a wall of the receiving cavity 41 such that air from the sound port 56 reaches the battery cell 52.

The battery module 50 may have a shape substantially conforming to the shape of the battery cell 52 incorporated within. For example, the battery cell 52 may be a button type cell as shown. The battery module 50 may accordingly be generally cylindrical in shape and configured to enclose a portion of the battery cell 52. Other form factors may be used, however it will be appreciated that by substantially conforming to the shape of the battery cell, the size of the battery module 50 and thus the overall size of the hearing aid device 30 is reduced. The shape may be substantially conforming in that it may not match the shape of the battery cell 52 exactly, but may be sufficiently similar to enclose a portion of the battery cell 52.

The battery module 50 includes a housing 53, which may, in some examples, have a substantially cylindrical shape. In some examples, the battery module 50 may include a handle 58 attached thereto. The handle includes a shaft portion 57 with a knob portion 5.

A sound port 56 is provided in the housing 53, the sound port being configured to allow sound 65 to be transmitted to the microphone of the main module 40 while minimizing debris and/or liquids from entering the main module 40. Incoming sound ports of conventional hearing aids frequently get soiled and clogged by debris. The sound port 56 (also referred to as an air port) of the battery module 50 incorporates an acoustically transparent debris barrier 51. The barrier 51 may be made of a porous membrane. In some examples, the membrane has pore sizes in the range of about 5 to about 25 microns. In this manner, the sound port 56 is configured to allow sound to pass through to the main module 40 when connected thereto while filtering out debris that can damage durable components within the main module 40, particularly the microphone within. Debris in the ear canal environment can be physiologic, or non-physiologic, and may include earwax, oils, water, particles, chlorine, shampoo, hair spray, etc. The sound port 56 (alternatively referred to herein as air port) is configured to deliver airborne sounds 65 to the microphone within the main module 40. Microphone port 45 is provided in the main module 40 at a location proximate the sound port 56 to couple sound between the air port/sound port 56 and the microphone of the main module 40.

Figure 6:
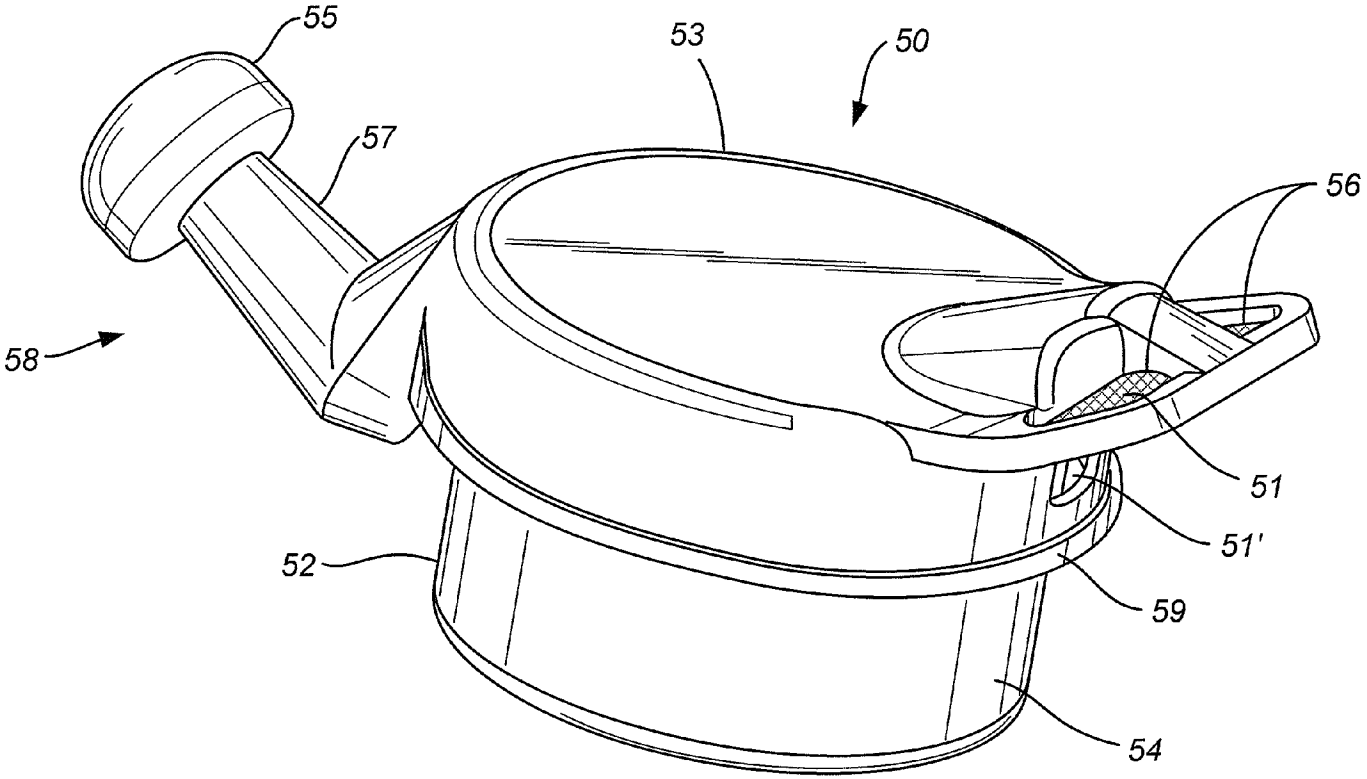
FIG. 6 is an illustration of an exemplary battery module.

As previously mentioned, the main module is also provided with an aperture 46 which operates as a battery air port 46 to provide air, if needed, to the battery-cell 52 within the battery module via battery air ports 51' (FIG. 6) when the battery module is in engagement with the main module and thereby enclosing the battery cell 52 therewithin. As will be appreciated, and further described herein, metal-air batteries known in the art, such as zinc-air batteries for example, require a flow of air/oxygen to the interior of the battery cell to effect the chemical reaction within. As such, the sound port 56 may simultaneously serve the purpose of allowing sound waves to be transmitted to the microphone and air/oxygen to be delivered to the battery cell, if needed. In some examples, devices configured to work with batteries other than metal-air batteries may not include an aperture 46 and the battery may be sealingly enclosed by the main module 40 and battery module 50 when the two are in engagement. In some examples, a plurality of apertures 46 may be provided. In some examples the sound port may be configured as a single or multiple individual air ports providing air exchange with the exterior of the device.

Figure 4:
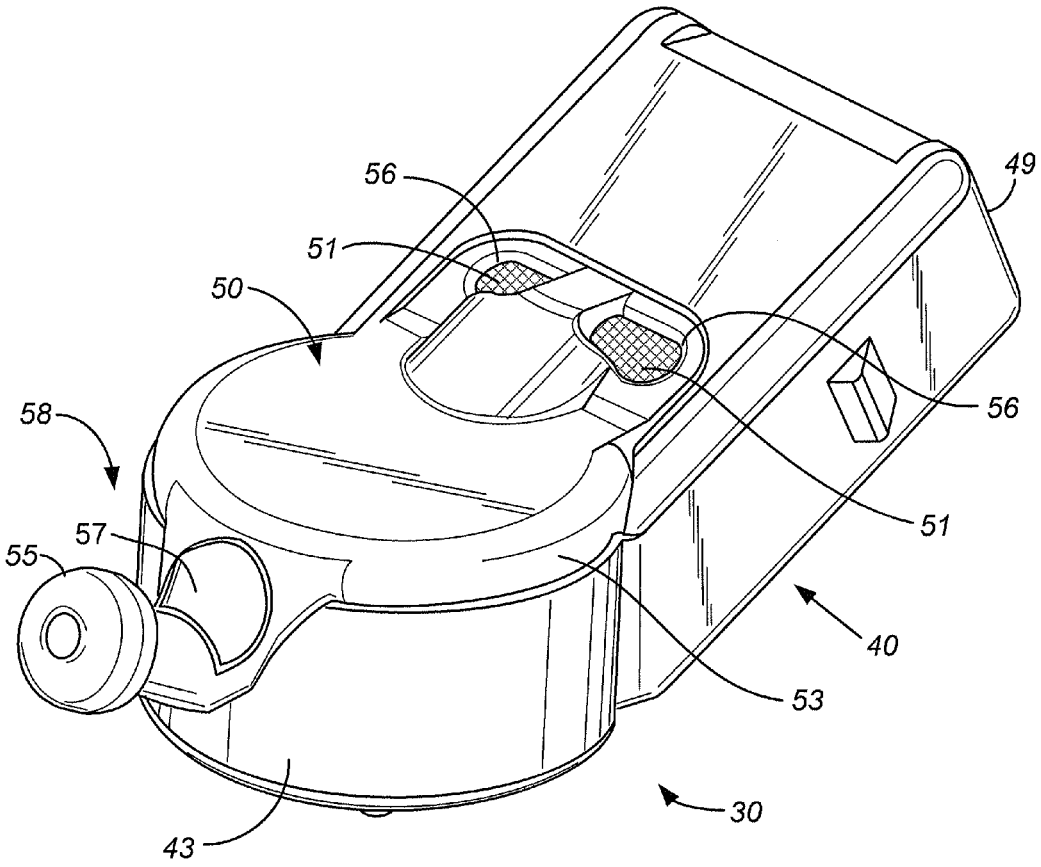
FIG. 4 is an illustration of an exemplary battery module shown inserted into the main module forming a hearing device assembly according to embodiments of the present invention.

FIG. 4 shows an illustration of an assembled hearing aid device according to examples of the present invention. Referring to FIGS. 3 and 4, prior to use, the battery module 50 may be connected to the main module 40 by inserting the battery module 50 in a generally perpendicular direction 7 into the generally circular receiving cavity 41 of the main module. The battery module 50 may then be inserted into engagement with the main module by snapping into place and being retained therein by structural features provided in the receiving well 41 of the main module. As will be understood, the coupling of the battery module to the main module couples the two components electrically, mechanically and acoustically for delivering power thereto, snapping mechanically thereto, and delivering incoming sound 65 to the microphone within the main module 40. The unique modular configuration provides a reliable, predictable, and cost effective ear canal hearing aid device by protecting expensive components designed for long term operation, while allowing for periodic replacement of degradable elements typically consumed in less than a month.

Figure 9:
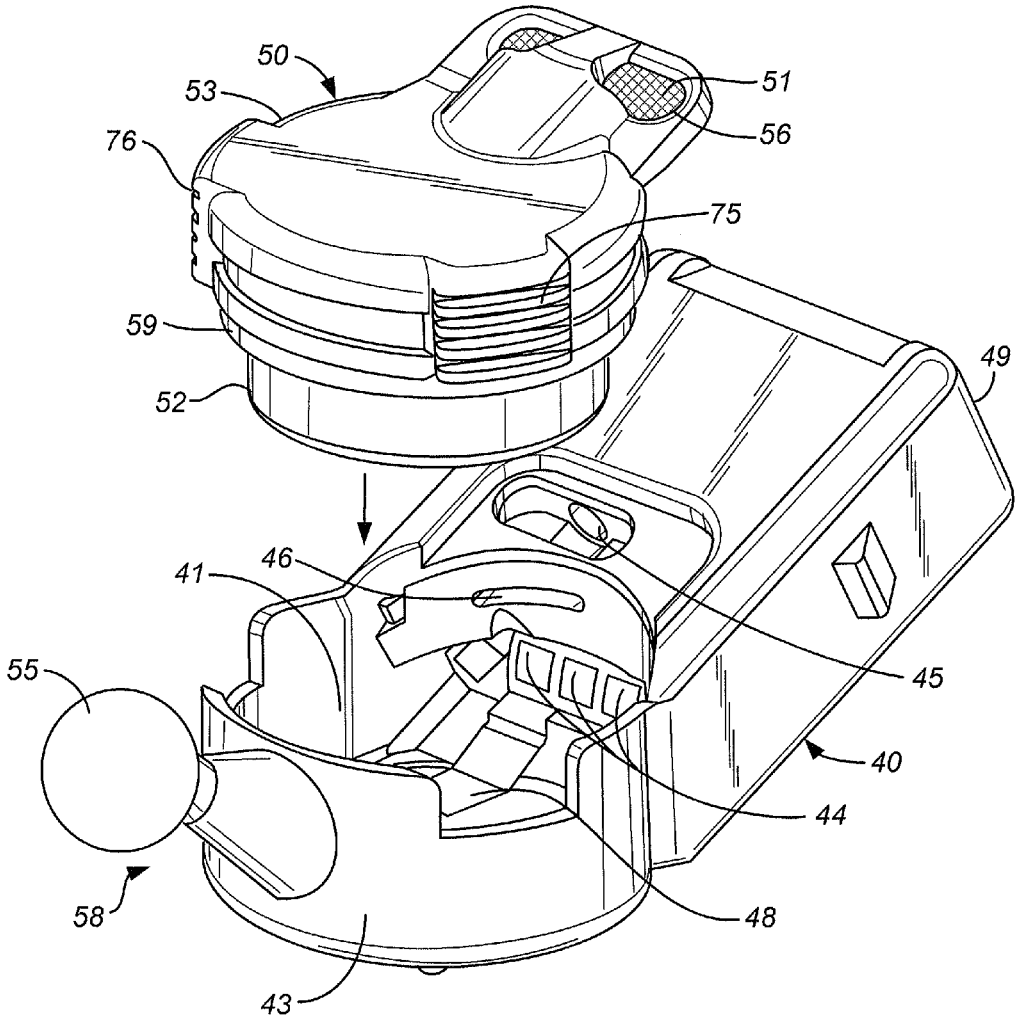
FIG. 9 shows another example of a battery module according to embodiments of the present invention.
Figure 10:
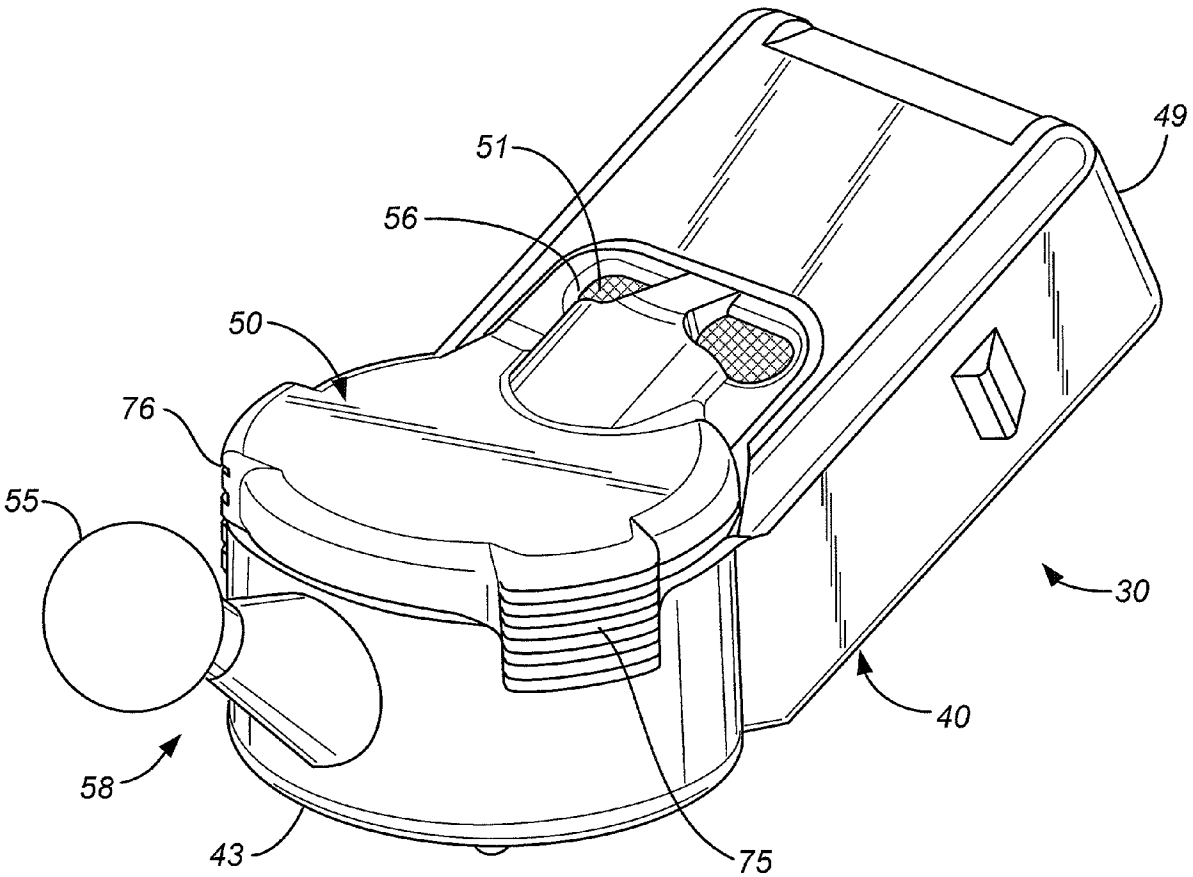
FIG. 10 shows an illustration of an assembled hearing aid device according to the example of FIG. 9.

As depicted in FIGS. 3-4, the unitary structure of the disposable battery assembly 50 may also incorporate a handle 58 to facilitate handling of the battery module alone during insertion into the main module 40, as well as handling the entire hearing device assembly 30 during its insertion into and removal from the ear canal. In some examples, the handle 58 may be attached to the housing of the battery module, as described herein. The handle 58, which may include a shaft 57 and a knob 55, is positioned generally opposite to the sound port 56 direction along a perimeter of the battery module. As will be appreciated, such a configuration may allow for proper alignment and effective coupling of the components as described herein. The main module may be provided with an indent in a wall of the receiving cavity to accommodate the protruding handle. The indent may further serve to aid in aligning the modules during engagement. In some examples, and as will be described further, the handle 58 may be attached to the main module instead (as depicted in FIGS. 9-10). The improved ergonomics which may be afforded by the examples of battery modules described herein may be particularly suited for the hearing impaired with limited dexterity and poor vision. Replacing a miniature battery module assembly 50 incorporating a handle may be far easier than replacing a miniature button-cell alone as in conventional canal hearing aid designs. Those skilled in the art of hearing aids and audiology will appreciate the advantages offered by the present disclosure.

In preferred embodiments, the battery module 50 is shaped substantially in the shape of a button-cell battery 52 housed therewithin to minimize the size of the battery module. The battery module 50 offers a highly space efficient design by integrating the battery cell within and thin-wall housing 53, which in some examples may be provided over a top portion of the battery cell instead of placing the cell entirely in a battery compartment as in the prior art. In this manner, the battery module 50 incorporates the battery cell 52, leaving a large portion of its exterior 54 substantially exposed to mate perpendicularly inside a receiving cavity 41 (which may be shaped as a well) within the main module 40. This arrangement allows for the battery cell and battery module to mate with the main module without resorting to elaborate electromechanical connectors or side snap inserts as in the prior art.

Figure 8:
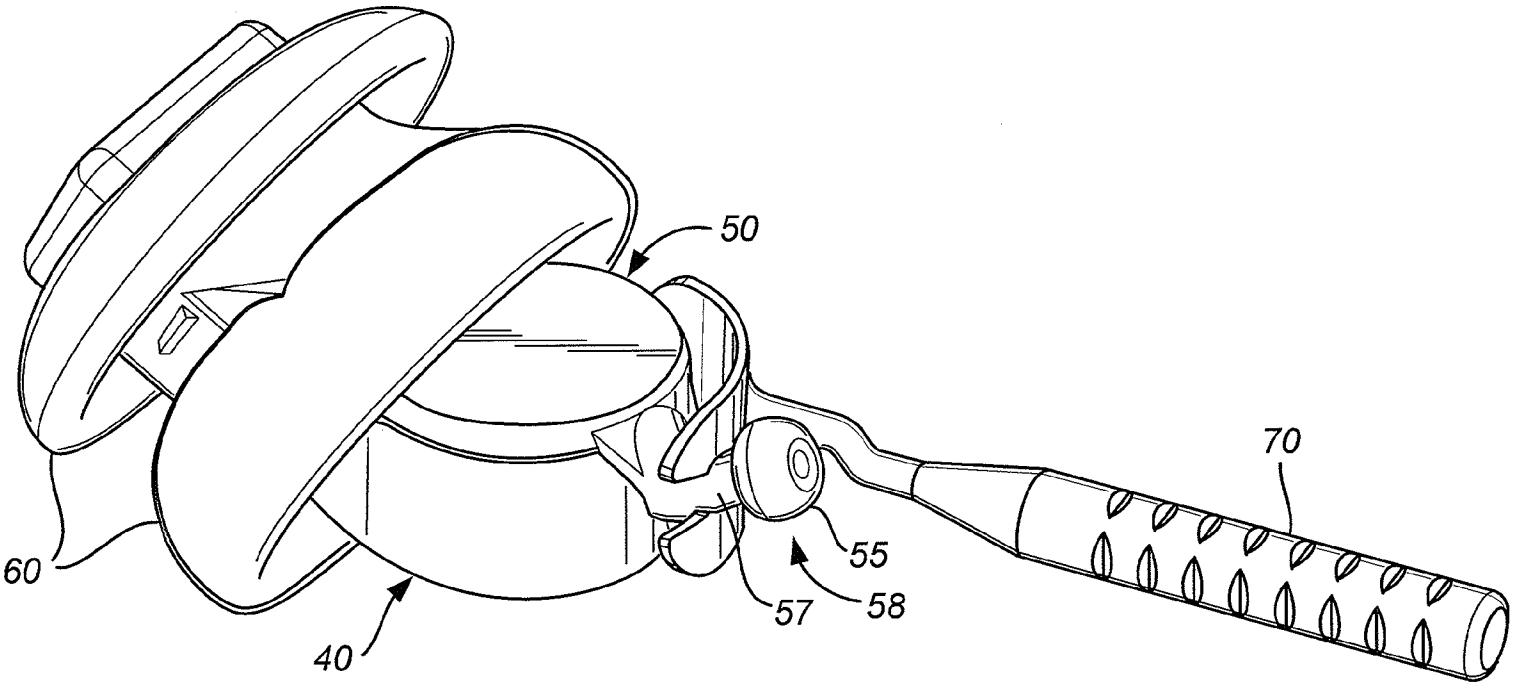
FIG. 8 is an illustration of an exemplary hearing aid system provided with an insertion/removal tool according to embodiments of the present invention.

FIG. 5 shows a view of a solid model rendering of an example hearing aid device inside the ear canal according to the present invention. The example hearing aid device 30 of FIG. 5 also shows an exemplary angular relationship between the battery module and main module, the advantages of which are described herein. The main module 40 is connected at its medial end 49 (towards the eardrum) to a seal tip assembly 60. The seal tip assembly 60 may be manufactured out of a flexible material, such as a polymer, and is preferably implemented as a replaceable or disposable component. The seal tip assembly 60 may be disposed about the medial end 49 of the main module. In some examples, the seal tip may enclose at least a portion of the main module as shown in FIGS. 5 and 8, for example. The seal assembly 60 in these preferred embodiments has a dual flange configuration (e.g., which may include flexible members 61 and 62) and may be configured to fit substantially in the cartilaginous region 12 of the ear canal but may extend into the bony region as well. The medial flange 61 may be positioned approximately at the bony-cartilaginous junction 8 and may extend into the bony region for acoustically sealing and delivering amplified sound from the medial end 49 of the main module 40 towards the eardrum in proximity. In this manner, the medial end 49 of the main module can extend safely into the bony region 13, or remain approximately at the junction area 8, depending on individual canal dimensions. The lateral flange 62 is preferred to be substantially in the cartilaginous region 12. The flexible members 61 and 62 may be implemented as medial flange 61 and lateral flange 62, which are configured to conform to the shape of the ear canal 10 in an acoustically sealing manner as shown in FIG. 5. As will be appreciated by those skilled in the art, sealing at the junction area 8, or medially beyond reduces feedback and minimizes the occlusion effect, which are highly objectionable for hearing impaired individuals, particularly those with significant residual hearing in the low frequency range. By placing the compliant seal assembly 60 concentrically over the main module 40, which is a rigid and non-compliant member, the risk of damage to the ear is minimized or essentially eliminated.

Another aspect of the examples according to the present invention described herein includes the perpendicular docking/mating design of the battery module 50 with respect to the main module 40, as described herein. The battery module 50 is configured to be insertable in the perpendicular direction 7 into a receiving well cavity 41 of the main module 40. As previously described, the cavity 41 is configured to receive the exposed portion 54 of the battery cell. The cavity 41 may be provided with a snap mechanism for snapping and securing the battery module within. The battery module 50 is similarly removed from the main module 40 by a perpendicular force away from the main module 40. As will be understood, when referring to a perpendicular direction in the context of the present disclosure it is meant a direction of movement or force which is substantially perpendicular to the generally longitudinal axes of the modules. For example, the directions 2 and 3 depict longitudinal directions relative to the battery module 50 and the main module 40, respectively. The present invention restricts the battery module 50 to perpendicular attachment and detachment thus minimizing the risk of inadvertent axial separation because the receiving cavity 41 completely surrounds the circumferential perimeter of battery cell 52. Since generally there is no significant perpendicular movement inside the ear canal 10, inadvertent separation of the battery module 50 during removal of the hearing device assembly 30 is essentially eliminated. In this manner, examples of the present invention provide secure attachment between the two modules and a space efficient design by eliminating connectors associated with modular designs of the prior art. For example, the electrical connection is made by the conductive surface 54 of the battery cell 52 as it mates with electrical contact pads 47 and 48 (positive and negative terminals) of the main module 40 within its receiving cavity 41. When the battery module 50 is inserted into the receiving cavity 41, the battery cell volume is substantially accommodated inside the main module without presenting any significant protrusion outside the main module 40, thus offering no significant increase in the assembled device 30 beyond the outer perimeter of the main module 40 alone. In contrast to modular hearing aid devices of the prior art, the present invention eliminates any significant lateral protrusion of the battery module by essentially encapsulating it within. In embodiments of the present invention, only the handle 58 may protrude laterally with respect to the main module with any incidental protrusion of the battery module 50 limited to less than ⅓ of the battery module, and certainly not in the lateral direction other than for the handle. In other words, at least ⅔ of the battery cell is inserted into the main module in the preferred embodiments.

The present invention minimizes costly damage and repair by incorporating degradable elements in a single unitary disposable assembly that can be replaced by the user as frequently as needed. For example, by employing a waterproof debris barrier 51, either over, within, or underneath the air port 56, water is prevented from reaching the electronic components and particularly the microphone in the main module 40, thus allowing the device to be worn safely during water exposure such as when swimming or showering. Should the air port 56 plugs or the debris barrier 51 become soiled, such as after exposure to chlorinated water in pools, hair spray, shampoo, etc., the disposable battery module 50 may simply be removed and replaced. The debris barrier 51 is preferably made of a porous film or membrane that is acoustically transparent (e.g., the membrane permits sound to be transmitted across the membrane). The pore size of the membrane is preferably in the range of about 5 to about 25 microns. This allows acoustic transparency while preventing water and debris from penetrating into the microphone of the main module. The debris barrier 51 in the preferred embodiments provides minimal acoustic attenuation of less than 3 decibels across the audiometric frequency range of 250-6,000 Hz.

Examples of the modular hearing device assembly 30 may be designed for positioning substantially in the cartilaginous region 12 for providing accessibly invisible wear therein as shown in FIG. 5 for example. The battery module 50 is positioned inconspicuously well inside the concha cavity 5 approximately at the aperture area 11 of the ear canal 10. This placement results in virtually invisible wear while allowing the user access to grasp the handle 58, which may be implemented as a knob-ended structure or other suitable structures for handling and manipulating the hearing device assembly 30 during insertion or removal from the ear canal.

The perpendicular insertion and circumferential encapsulation of the battery module 50 by the main module 40, particularly by it lateral end 43, prevents accidental disengagement of the two modules during removal from the ear canal when lateral axial force in the axial directions (2 and 3) is applied. As will be understood, the battery module 50 can be readily disconnected from the main module 40 upon applying a pull force in the perpendicular direction 7. The device 30 is configured such that replacement of the battery module 50 is accomplished only when the device 30 is outside the ear canal.

FIG. 8 shows an illustration of an exemplary hearing aid system 30 provided with an insertion/removal tool 70 according to embodiments of the present invention. For some individuals with good manual dexterity, no tools may be required to engage or disengage the battery module and install/remove the hearing aid device 30 other than by hand. In some examples a hearing aid system according to the present disclosure may include a removal and/or installation tool 70 for users, particularly those with limited dexterity.

In some preferred embodiments, the battery module 50 may be replaced every 5-15 days, depending on power consumption, utilization, and user environment. Users with frequent water exposure, or excessive earwax production, are likely to replace the battery module 50 more frequently since the air port 51 is more likely to get plugged frequently. The battery module 50 according to examples described herein is advantageously configured to be replaceable whenever any of the degradable parts within the battery module 50 become degraded. Other degradable parts within the battery module 50 include a sealing member 59, such as a waterproofing O-ring for example, may be provided to seal the interface between the modules. Periodic replacement of the battery module 50 is desirable for long-term reliability and function for the main module 40.

The handle 58 of the battery module 50 preferably includes a shaft portion 57 and a knob portion 55. Other form factors may of course be used and the handle may be effectively configured to assist in grasping the battery module and/or assembled hearing aid device 30 by finger tips or with the insertion tool during manipulation and insertion into the ear canal, or removal therefrom.

In some examples, the handle is an integral part of the battery module housing 53. The handle and housing may be formed as a unitary structure by methods known in the art. For example, the handle and housing may be formed as a monolithic molded part. In these preferred embodiments, the housings of main module and battery modules, including the handle, may be made of high quality thermoplastic material, such as PEEK. This allows for minimal thickness and accordingly smallest possible size of the device, while providing excellent mechanical and chemical properties in the hostile environment of the ear canal. In addition to allowing manual manipulation, the shaft 57 and knob 55 structures of the handle 58 allow for engagement with a removal or insertion tool 70 as described herein and shown in FIG. 8.

In the preferred embodiments, the shaft is oriented at an angle of approximately 30° degrees, or between about 20° to about 35°, with respect to a general axial orientation 2 (FIG. 5) of said battery module 50. This orientation aids in centering the handle relative to the ear canal cavity and allows for convenient grasping of the device by finger, or by a removal tool 70, without interference with the walls of the ear in the concha cavity 5. The lateral section 43 of the main module, and the battery module 50 inserted therein, may also designed to be oriented at an angle of approximately 25°, preferably between 20° and 30°, with the respect to the generally axial orientation 3 of the main module 40 as shown in FIG. 5, for example. The advantages of angling the axial/longitudinal direction of battery module relative to an axial direction of the main module will be appreciated by those skilled in the art and are described further below.

Safety consideration for preventing deeper insertion and damage is important and may be addressed by the overall design of devices 30 according to examples of the present invention. Factors that may provide a level of safety and comfort of wear include overall small dimensions of the device, as well as orientation of the modules relative to each other and relative to the ear canal. For example, the length of the assembled device 30, excluding the handle, may be approximately 14 mm which is significantly less than the total length of the ear canal for adults, which is approximately 26 mm from the aperture 11 to the eardrum 15. The aforementioned orientations of the modules and handle results in an essentially "C" shaped configuration, as shown in FIG. 5, allow for the device to fit comfortably along the contour of the ear canal from concha cavity, through the first bend inside the ear canal, and to the junction area 8. This design also provides a counter fit, or interference, relative to the second bend of the "S" shaped ear canal. That is, in some examples, the angled configuration of the device 30 allows for the device to be insertable up to the second contour of the ear canal, while preventing its insertion deeper into the ear canal. This leaves the medial end 49 safely positioned either at the bony-cartilaginous junction 8, or slightly into the bony region 13, within considerable safe distance from the eardrum. In example devices according to the invention, the hearing aid assembly 30 terminates at least 8 mm away from the eardrum.

As will be appreciated, battery modules and hearing aid devices and systems according to the examples described herein are well suited for mass-production, and may be provided in assorted sizes for fitting in a sealing manner within a variety of individual ear canals. In some examples, the device may be remotely controlled for activation or adjustment by means known in the art. The battery module 50, as described herein, is configured to provide a snap mechanical fit into the main module which can be lifted or otherwise removed from the main module by a force applied generally in a perpendicular direction. As will be understood, in some examples a force may be applied along non-perpendicular directions, which may include sufficient perpendicular component to disengage the battery module from the main module of the device. Partial removal of the battery module may also be provided for allowing for an OFF power position while keeping the modules together. In one embodiment, a switch 42 at the lateral end 43 of the main module 40 may be provided to switch off the device when not in use without requiring to remove or lift the battery module 50 from the main module 40. In some examples, the switch may be located elsewhere. The battery module 50 may also incorporate a rechargeable battery for periodic charging by a charging system (not shown).

Examples of hearing aid devices of the present invention are configured to be water-resistant and/or to withstand moisture and water exposure. In one embodiment, a waterproofing seal in the form of an O-ring 59 is incorporated within the battery module 50 to seal the interface between the modules when connected. The sealing O-ring 59 is preferably made of an elastomeric material such as Silicone®. Should the battery module 50 becomes damaged, air port 56 plugged by earwax, or its cell 52 depleted, the battery module 50 may be removed and replaced while maintaining the relatively more expensive main module 40 for long term use and operation.

Figure 7:
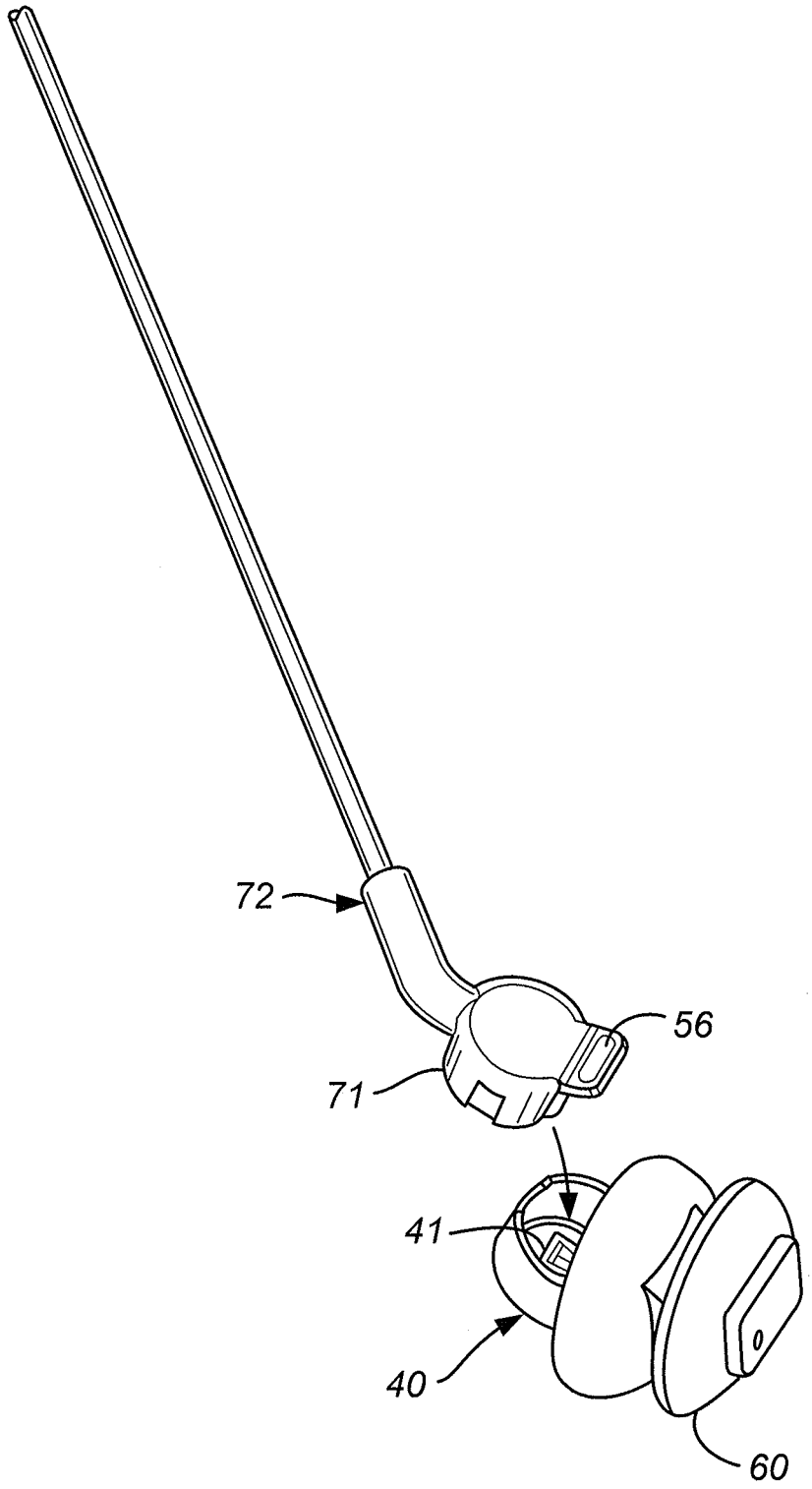
FIG. 7 is an illustration of an example programming connector having a programming plug and connector cable for connecting a main module according to examples described herein to a programming device.

FIG. 7 shows an illustration of an example programming cable assembly for use with the canal hearing aid devices according to embodiments of the present invention. The programming cable assembly 72 includes a programming plug 71 configured to be inserted into the receiving cavity 41 of the main module. The programming plug is used for connecting a main module to a programming device (not shown). The programming plug 71 provides power to the main module 40 via battery contacts 47 and 48 and programming data via data contacts 44. In this manner, the programming cable assembly 72 provides power and/or data communication from external devices. In some embodiments, the programming cable assembly 72 connects to a programming interface (not shown) and/or to a personal computer (not shown) via standard interface such as a USB port. In some examples, the programming interface may be configured to communicate with standard computer systems wirelessly. The programming cable assembly preferably provides audio signals to the hearing device 30 for administering hearing testing and fitting evaluations. The fitting and programming in some embodiments may be web-enabled to provide interactive fitting and remote assistance to a user being fitted with hearing devices 30 according to the present invention. It should be understood that the term "PC" or personal computer used herein should not be limited to a standard personal computer but rather used generically herein to refer to any microprocessor-based device that is operable to execute software applications or hardwired for a specific application, or can be connected to the Internet. This may include cell phones, smart phones, tablet computers, notebooks, pocket computers, personal digital assistant (PDA), appliances, etc.

Using the fitting cable assembly 72 shown in FIG. 7, the fitting prescription for an individual can be determined, validated and fine-tuned by presenting various test signals including speech, words, music, noises, environmental sounds, etc. Since PCs are readily adapted to Internet applications, the user can connect the main module to a web-based application and the fitting process can be performed automatically or with the assistance of a hearing professional present in a remote location via the Internet. It is well within the scope of examples of the present invention to present a fitting process partially or entirely via the Internet. Programming and connections to the Internet may also be performed wirelessly with the appropriate interface.

FIGS. 9-10 show another example of a battery module according to embodiments of the present invention. In the examples depicted in FIGS. 9-10, the handle 58 may be incorporated within the main module 40. For example, the handle 58 may be located at the lateral end 43 of the main module. In this embodiment, the battery module 50 incorporates grips 75 & 76. The grips 75 and 76 may be implemented as a plurality of ridges which may extend slightly from the perimeter of the battery module. The grips 75 and 76 are preferably disposed generally opposite each other or may be located at any position about the perimeter of the battery module. The grips are configured to allow the user to grip the battery module by fingers to allow insertion and removal of the battery module 50. Of course, as will be appreciated, any number, or other form factors or similar structures adapted for gripping and manipulating the battery module may also be used. As depicted in FIG. 10, when assembled, the grips 75 and 76 may be at least partially accommodated within indentations within the main module thereby minimizing the overall size of the hearing aid device.

Although examples of the invention have been described herein, it will be recognized by those skilled in the art to which the invention pertains from a consideration of the foregoing description of presently preferred and alternate embodiments and methods of fabrication and use thereof, that variations and modifications of this exemplary embodiment and method may be made without departing from the true spirit and scope of the invention. Thus, the above-described embodiments of the invention should not be viewed as exhaustive or as limiting the invention to the precise configurations or techniques disclosed. Rather, it is intended that the invention shall be limited only by the appended claims and the rules and principles of applicable law.

What is claimed is:

1. A battery module for use with a main module of a hearing aid device, the battery module comprising:

an air port for allowing sound to reach to microphone provided in the main module of the hearing aid device;

a handle; and a battery cell configured for insertion into the main module to form hearing aid assembly, Wherein the battery module is configured for insertion into the main module along a direction substantially perpendicular to the axis of movement of the hearing aid device inside the ear canal, thereby necessitating removal of said hearing aid assembly from the ear canal for removal the battery module from the main module; wherein the battery cell is substantially accommodated and enclosed, circumferentially laterally, within the main module when the battery module is inserted therein.

2. The battery module of claim 1, wherein the air port comprises a membrane for allowing sound to be transmitted to the microphone within the main module while preventing water and debris from penetrating the membrane.

3. The battery module of claim 1, wherein the handle comprises a shaft portion and a knob portion.

4. The battery module of 1, wherein the handle is arranged at an angle of about 20° to about 35° with respect to the axial direction of the battery module.

5. The battery module of claim 1, Wherein the battery module comprises an elastomeric ring sealably engaging with the main module.

6. A battery module for a hearing aid device comprising:

an air port for allowing sound to be transmitted to a microphone provided in the hearing aid device; and a battery cell configured for insertion into the hearing aid device along a direction substantially perpendicular to the direction of movement of the hearing aid device inside the ear canal, thereby necessitating the removal of the hearing aid device from the ear canal for removal of the battery module from the main module;

wherein the battery cell is substantially accommodated and accommendated and enclosed, circumferentially and laterally, within the hearing aid device when the battery module is inserted therein.

7. The battery module of claim 6, wherein the air port comprises a filter configured to allow sound to he transmitted to the microphone while preventing debris from penetrating the membrane.

8. The battery module of claim 7, wherein the filter is a porous membrane having a pore size of about 25 microns.

9. The battery module of claim 6, wherein the battery cell is a button cell type.

10. The battery module of claim 6, wherein the battery module comprises an elastomeric ring for preventing water from entering the interior of the hearing aid device.

11. The battery module of claim 6 further comprising a handle, wherein the handle is molded with the housing of said battery module.

12. The battery module of claim 11, wherein the handle comprises a shaft portion and a knob portion.

13. The battery module of claim 11, wherein the handle is oriented at a angle between 20°-35° with respect to the general axial orientation of the battery module.

14. The battery module of claim 11, wherein said handle is configured to operably engage with any of a removal tool and an insertion tool.

15. The battery module of claim 6 further comprising an air port configured to allow air to reach the battery cell within.

16. A modular hearing device for inconspicuous wear inside the ear canal, the modular hearing device comprising:

a main module configured to be positioned substantially inside the ear canal, said main module including a microphone, an amplifier circuit, and a receiver, the main module further comprising a receiving portion for coupling a battery module to the main module, wherein the receiving portion is configured to releasably secure a battery module inserted into the main module in a substantially perpendicular direction relative to a direction of movement of the modular hearing device inside the ear canal;

a seal assembly disposed about a portion of said main module, the seal assembly configured to conform to walls of the ear canal in an acoustically sealing manner; and a battery module comprising a battery cell, and an air port configured to allow sound to reach a microphone incorporated in said main module when the battery module is connected thereto forming a hearing device assembly, wherein the battery module is configured for insertion into the main module in a direction substantially perpendicular to the direction of movement of the hearing device inside the ear canal, and thereby necessitating removal of the modular hearing device from the ear canal for removal of the battery module from said main module; wherein the battery cell is substantially accommodated and enclosed circumferentially and laterally, within the main module when the battery module is inserted therein.

17. The modular hearing device of claim 16, wherein the air port comprises a membrane for allowing sound to reach the microphone while preventing debris from penetrating the membrane.

18. The modular hearing device of claim 17, wherein the membrane is porous, with pore sizes of about 25 microns.

19. The modular hearing device of claim 16, wherein the air port is further configured to allow air to reach the battery cell when the battery module and the main module are in engagement.

20. The modular hearing device of claim 16, wherein h battery cell is a button cell type.

21. The modular hearing device of claim 16, wherein the battery module comprises an elastomeric ring configured to prevent liquids from entering the interior portion of said hearing device when the battery module and the main module are in engagement.

22. The modular hearing device claim 16, further comprising a handle.

23. The modular hearing device of claim 22, wherein the handle comprises a Shaft portion and a knob portion.

24. The modular hearing device of claim 22, wherein the handle is arranged at an angle of about 20° to about 35° with respect to a longitudinal directional of the battery module.

25. The modular hearing device of claim 22, wherein the handle is configured to operate with any of a removal tool and an insertion tool.

26. The modular hearing device of claim 16 wherein the axial direction of the battery module forms an angle of about 30° with it longitudinal direction of the main module.

27. The modular hearing device of claim 16, further configured in a generally "C" shape configuration, such that the hearing aid device is insertable substantially in the first contour of the "S" shaped ear canal.

28. The modular hearing device of claim 16, further configured to be inserted inside the ear canal up to a distance of at least 8 mm from the eardrum.

29. The modular hearing device of claim 16, wherein the main module further comprises a switch.

30. The modular hearing device of claim 16, wherein the main module is configured to be coupled to a programming assembly comprising a programming plug adapted to be inserted into the main module when the battery module is removed.

* * * * *